US010302273B2

(12) United States Patent
Liao

(10) Patent No.: US 10,302,273 B2
(45) Date of Patent: May 28, 2019

(54) LAMPSHADE AND FRAME ASSEMBLY

(71) Applicant: Frank Huzi Jung Liao, City of Industry, CA (US)

(72) Inventor: Frank Huzi Jung Liao, City of Industry, CA (US)

( * ) Notice: Subject to any disclaimer, the term of this patent is extended or adjusted under 35 U.S.C. 154(b) by 23 days.

(21) Appl. No.: 15/678,070

(22) Filed: Aug. 15, 2017

(65) Prior Publication Data

US 2019/0056084 A1 Feb. 21, 2019

(51) Int. Cl.
*F21V 1/06* (2006.01)
*F21V 1/14* (2006.01)
*F21V 1/08* (2006.01)

(52) U.S. Cl.
CPC ..... *F21V 1/06* (2013.01); *F21V 1/143* (2013.01)

(58) Field of Classification Search
USPC ..... 362/352, 351, 84, 319
See application file for complete search history.

(56) References Cited

U.S. PATENT DOCUMENTS

2003/0142497 A1* 7/2003 Wu ..... F21V 1/06 362/352
2004/0109320 A1* 6/2004 Sun ..... F21V 1/06 362/352
2012/0044702 A1* 2/2012 Chen ..... F21V 1/02 362/351
2013/0155692 A1* 6/2013 Federici ..... F21V 1/02 362/353
2013/0314894 A1* 11/2013 Liao ..... F21V 1/00 362/84

* cited by examiner

*Primary Examiner* — Edwyn Labaze
(74) *Attorney, Agent, or Firm* — Raymond Y. Chan; David and Raymond Patent Firm

(57) ABSTRACT

A lampshade and frame assembly includes a lampshade body having a lampshade covering includes an upper periphery, a lower periphery, a plurality of upper hooks spacedly attached on the upper periphery, and a plurality of lower hooks spacedly attached on the lower periphery; a frame body comprising a lamp supporting frame having an outer circular frame member detachably coupled with the upper hooks, and a lower frame having an lower annular frame member detachably coupled with the lower hooks to associate the lampshade body with the frame body; an upper frame having an upper annular frame member covered on the lamp supporting frame; wherein each of the upper hook comprises a downwardly and inwardly extending recess for allowing said outer circular frame member being inserted therein, and the lower hooks comprises a upwardly and inwardly extending recess for allowing the lower annular frame being inserted therein.

9 Claims, 4 Drawing Sheets

LAMPSHADE AND FRAME ASSEMBLY

NOTICE OF COPYRIGHT

A portion of the disclosure of this patent document contains material which is subject to copyright protection. The copyright owner has no objection to any reproduction by anyone of the patent disclosure, as it appears in the United States Patent and Trademark Office patent files or records, but otherwise reserves all copyright rights whatsoever.

BACKGROUND OF THE PRESENT INVENTION

Field of Invention

The present invention relates to a lampshade, and more particularly to a lampshade detachably associated with a supporting frame to achieve a simple construction, a low cost of manufacture, an easy to disassemble for storage and transportation, and an easy to assemble for use.

Description of Related Arts

A conventional lampshade comprises a frame body and a shade body embracing around the frame body to concentrate the light beams and enhance the light effects, wherein the frame body having a plurality of supporting frames melded with each other to form the frame body, and the shade body is generally made of a sheet of fabric or paper material. Since the shade body and the frame body are affixed with each other to form a rigid structure, the frame body cannot be disassembled. However, during delivery, the above mentioned lampshades occupied a lot of spaces and then significantly increase the cost of transportation. In addition, when the lampshades are prepared to store, much storage space is required. In other words, the lampshade is not collapsible. In order to enhance the aesthetic and update the room's decoration, the lampshades are required to exchange to satisfy customer's needs. Therefore, a plurality of improved detachable lampshades are launched in the current markets.

An improved detachable lampshade is provided in the current market, wherein the lampshade body and the frame body are detachably coupled with each other by Velcro members. The improved detachably lampshade comprises a plurality of first Velcro members (hook surfaces) mounted with a top frame and a bottom frame of the frame body, and a plurality of second Velcro members (loop surfaces) mounted with a top periphery and a bottom periphery of the lampshade body to detachably fasten with the first Velcro members of the frame body. In other words, the lampshade body and the frame body can be easily detach while the lampshade is not in use, and it is also very convenient for the customers for exchanging the lampshade body having different patterns and materials. However, this improved lampshade has the following drawbacks.

Lint, threads, or hairs are easily to accumulate on the Velcro members, and the lint, threads, or hairs are very difficult to remove from the Velcro members. In other words, the Velcro's effectiveness is reduced over time even through the Velcro members are not repeatedly use. Also, the hook surfaces can grab onto other materials which are not the loop surfaces, and it may cause damage on other materials in some cases. Furthermore, the tearing noise that the Velcro members make always can be a disadvantage in circumstances where someone want to stay in quiet.

SUMMARY OF THE PRESENT INVENTION

The invention is advantageous in that it provides a lampshade and frame assembly, wherein a lampshade body can be detachably coupled with a lamp supporting frame and a lower frame of a frame body.

Another advantage of the invention is to provide a lampshade and frame assembly which can be disassembled during transportation and is not in use, and is simply assembled the lampshade body and frame body while the lampshade and frame assembly is in use.

Another advantage of the invention is to provide a lampshade and frame assembly, wherein the lampshade body comprises a lampshade covering having a plurality of upper hooks and a plurality of lower hooks arranged on an upper periphery and a lower periphery thereof respectively to associate with the lower frame and the lamps supporting frame, so as to detachably couple the lampshade body and the frame body.

Another advantage of the invention is to provide a lampshade and frame assembly, wherein the lampshade covering is made of resilient materials, so the lampshade covering can be folded in a compact size while the frame body is detached from the lampshade body.

Another advantage of the invention is to provide a lampshade and frame assembly, wherein the lampshade covering comprises a smooth internal surface, a rough outer surface, and an outer surface covering attached on the rough outer surface having two ends extending to the smooth internal surface. In other words, the upper hooks and lower hooks are embedded between the smooth internal surface and the outer surface veering.

Another advantage of the invention is to provide a lampshade and frame assembly, wherein the lower frame and the upper frame comprises a lower supporting sheet and a upper supporting sheet attached on an inner periphery of the lower frame and the upper frame to enhance light reflections, so as to improve the illuminating effect.

Another advantage of the invention is to provide a lampshade and frame assembly, wherein the lower supporting sheet comprises a plurality of lower positioning slots spacedly aligned with positions of the lower hooks to guide the lower hooks being detachably coupled on the lower frame.

Another advantage of the invention is to provide a lampshade and frame assembly, wherein the upper hooks and lower hooks are evenly and spacedly arranged on an upper periphery and a lower periphery of the lampshade body to reduce unbalance situations while the frame body is coupled with the lampshade body.

Another advantage of the invention is to provide a lampshade and frame assembly, which is inexpensive, simple to manufacture and easy to assemble and disassemble.

Another advantage of the invention is to provide a lampshade and frame assembly, which does not require to alter the original structural design of the lampshade, so as to minimize the manufacturing cost of the lampshade body and frame body.

Another advantage of the invention is to provide a lampshade and frame assembly, wherein no expensive or complicated structure is required to employ in the present invention in order to achieve the above mentioned objects. Therefore, the present invention successfully provides an economic and efficient solution for providing a detachable configuration between the lampshade body and the frame body for facilitating the usage of lampshade and frame assembly.

Additional advantages and features of the invention will become apparent from the description which follows, and may be realized by means of the instrumentalities and combinations particular point out in the appended claims.

According to the present invention, the foregoing and other objects and advantages are attained by a lampshade and frame assembly, comprising:

a lampshade body having a lampshade covering comprising an upper periphery, a lower periphery, a plurality of upper hooks spacedly embedded inside the upper periphery, and a plurality of lower hooks spacedly embedded inside the lower periphery;

a frame body comprising a lamp supporting frame having an outer circular frame member detachably coupled with the upper hooks, and a lower frame having an lower annular frame member detachably coupled with the lower hooks to associate the lampshade body with the frame body;

an upper frame having an upper annular frame member covered on the lamp supporting frame; wherein each of the upper hooks comprises a downwardly and inwardly extending recess for allowing the outer circular frame member being hanged therein, and the lower hooks comprises an upwardly and inwardly extending recess for allowing the lower annular frame being hanging therein.

In accordance with another aspect of the invention, the present invention comprises a method for detachably coupling a lampshade body with a frame body, comprising the steps of:

A method for assembling a lampshade body with a frame body, comprising the steps of:

(a) Deposing a lower frame of the frame body into the lampshade body for associating the lower frame with lower hooks on the lampshade body; and (b) Deposing a lamp supporting frame of the frame body into the lampshade body, and pulling up the lamp supporting frame until upper hooks on the lampshade body are coupled with an outer circular frame member of the lamp supporting frame.

Still further objects and advantages will become apparent from a consideration of the ensuing description and drawings.

These and other objectives, features, and advantages of the present invention will become apparent from the following detailed description, the accompanying drawings, and the appended claims.

DETAILED DESCRIPTION OF THE PREFERRED EMBODIMENT

The following description is disclosed to enable any person skilled in the art to make and use the present invention. Preferred embodiments are provided in the following description only as examples and modifications will be apparent to those skilled in the art. The general principles defined in the following description would be applied to other embodiments, alternatives, modifications, equivalents, and applications without departing from the spirit and scope of the present invention.

Figure 1:
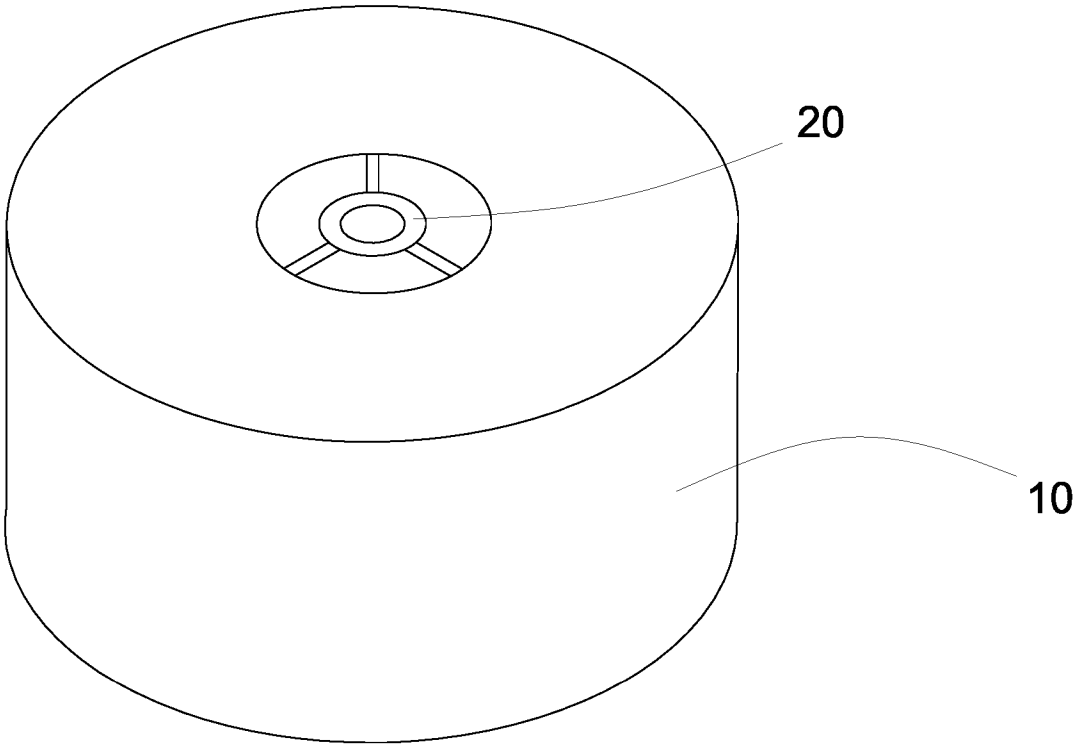
FIG. 1 is a perspective view of a lampshade and frame assembly according to a preferred embodiment of the present invention.
Figure 2:
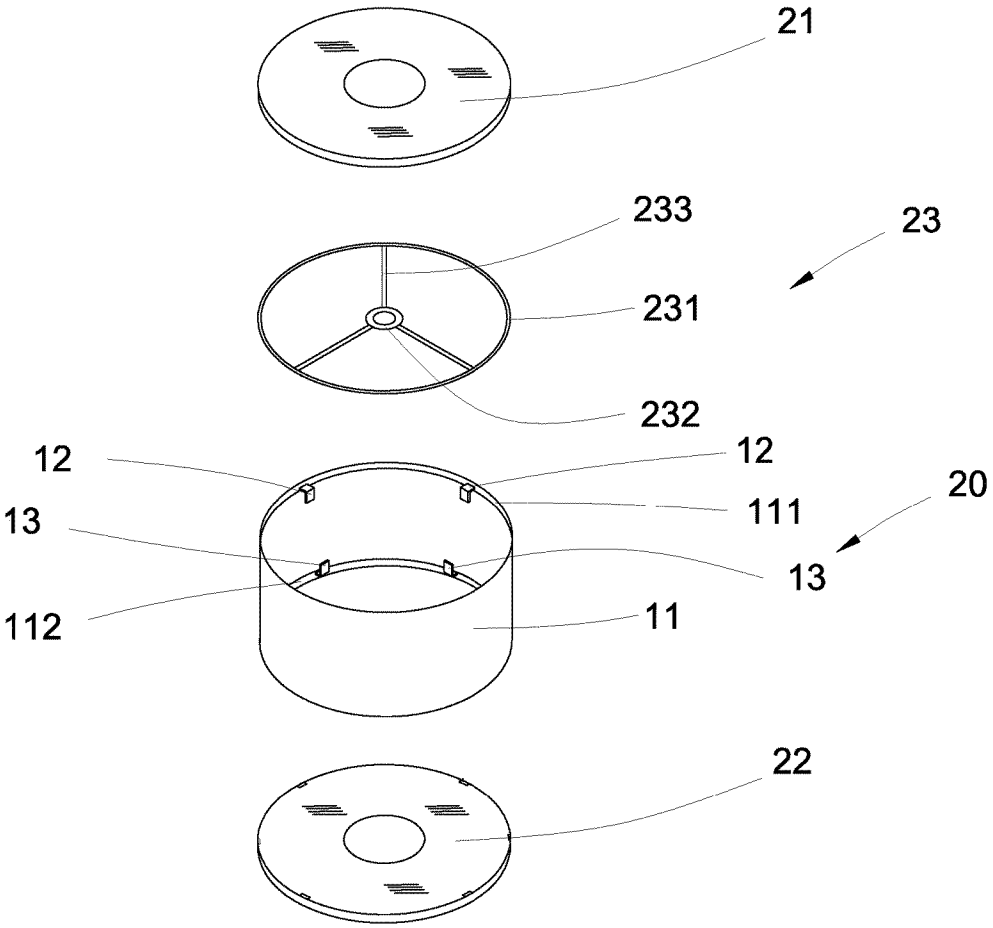
FIG. 2 is an exploded view of the lampshade and frame assembly according to the above preferred embodiment of the present invention.
Figure 3A:
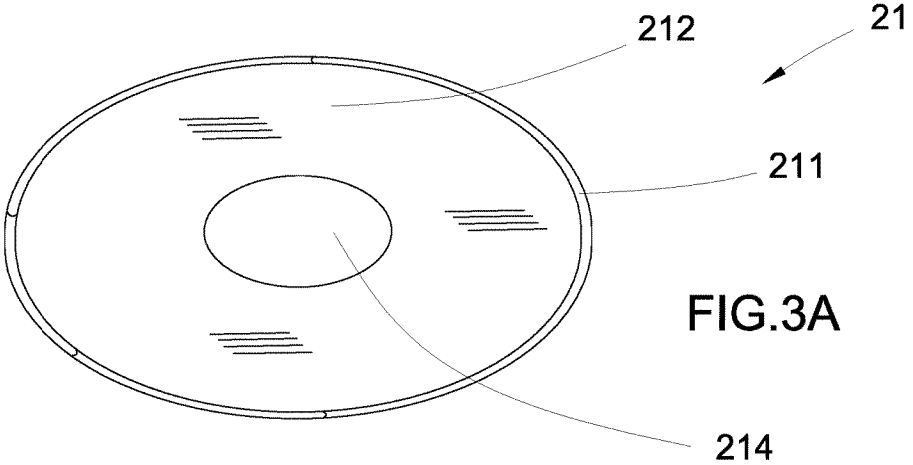
FIG. 3A is a perspective view of an upper frame of a frame body according to the above preferred embodiment of the present invention.
Figure 3B:
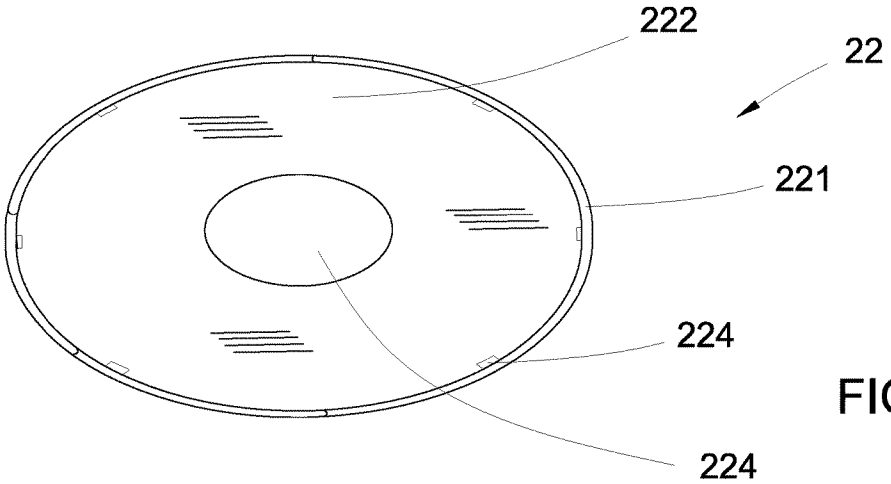
FIG. 3B is a perspective view of a lower frame of a frame body according to the above preferred embodiment of the present invention.

Referring to FIG. 1 to FIG. 3 of the drawings, a lampshade and frame assembly according to a preferred embodiment of the present invention is illustrated, wherein the lampshade and frame assembly comprises a lampshade body 10 and a frame body 20 detachably coupled with the lampshade body.

The lampshade body 10 comprises an continuous lampshade covering 11 having a upper periphery 111 and a lower periphery 112, a plurality of upper hooks 12 embedded inside the upper periphery 111 of the lampshade covering 11, and a plurality of lower hooks 13 embedded inside the lower periphery 112 of the lampshade covering 10, wherein the upper hooks 12 are spacedly and evenly arranged on the upper periphery 111 of the lampshade covering 11, and the lower hooks 13 are spacedly and evenly arranged on the lower periphery 112 of the lampshade covering 11. In other words, the lower hooks 12 and the lower hooks 13 are detachably coupled with the frame body 20.

Figure 4:
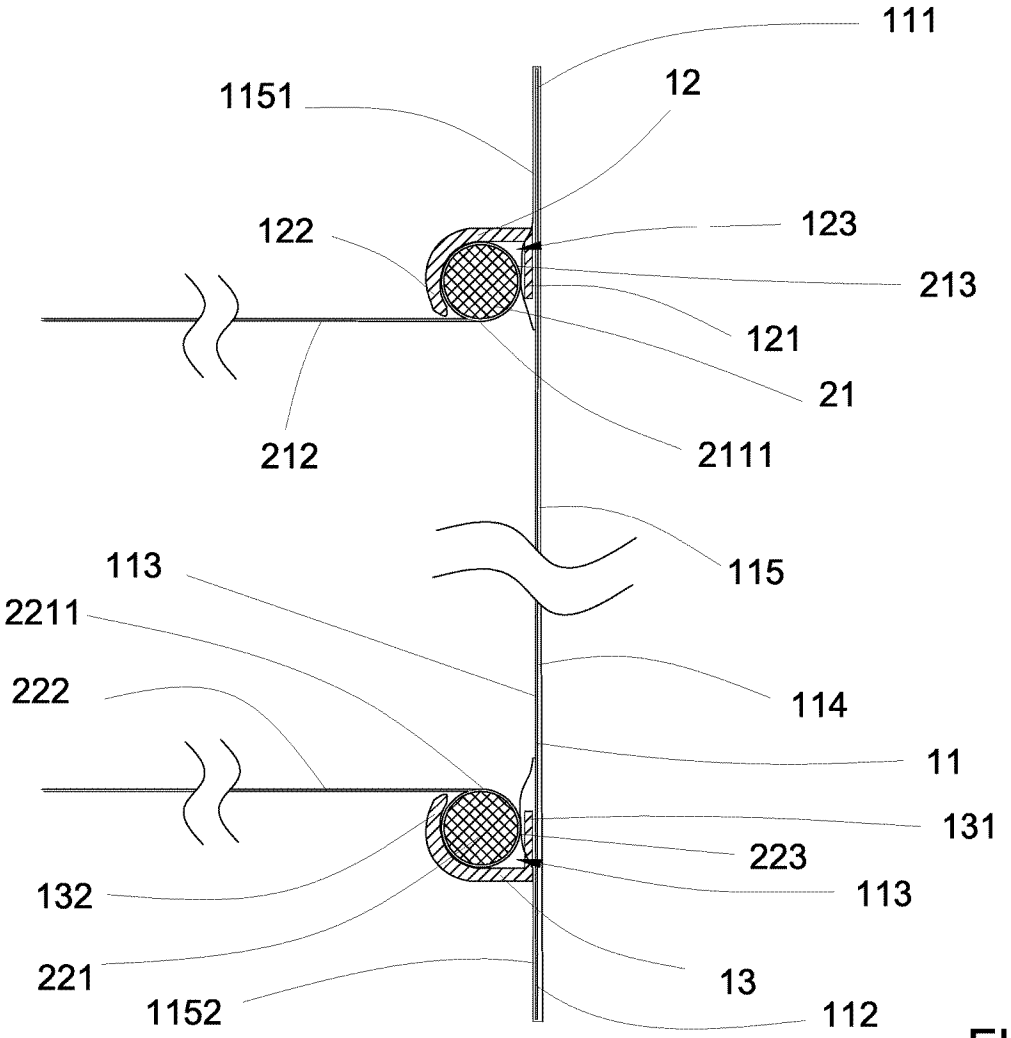
FIG. 4 is a side view of an upper hook and a lower hook according to the above mentioned preferred embodiment of the present invention, illustrating a lower frame and a lamp supporting frame associated with a lampshade body.

Referring to FIG. 4 of the drawings, each of the upper hooks 12 comprises one end 121 embedded into the upper periphery 111 of the lampshade covering 11, and the other end 122 is downwardly and inwardly extending to form an upper hook recess 123. Also, each of the lower hooks 13 comprises one end 131 embedded into the lower periphery 112 of the lampshade covering 11, and the other end 132 is upwardly and inwardly extending to form a lower hook recess 133. It is worth mentioning that each of the upper hooks 12 is symmetrically arranged with respect to each of the lower hooks 13. In other words, each of the upper hooks 12 is located at a position aligned with a position of each of the lower hooks 13.

Accordingly, the frame body 20 comprises an upper frame 21 and a lower frame 22, wherein the upper frame 21 and the lower frame 22 have similar structure. The upper frame 21 comprises an upper annular frame member 211, an upper supporting sheet 212 attached with an inner periphery of the upper annular frame member 211 to form an upper supporting flat surface by a upper non-woven fabric 213, and an upper central hole 214 formed at a center of the upper supporting sheet 212. The lower frame 22 comprises a lower annular frame member 221, a lower supporting sheet 222 attached with an inner periphery of the lower annular frame member 221 by a lower non-woven fabric 223, a plurality of lower positioning slots 224 spacedly formed adjacent to an outer periphery of the lower supporting sheet 222, and a lower central hole 224 formed in a center of the lower supporting sheet 224. The lower annular frame member 221 is inserted into the lower hook recesses 133 of the lower hooks 13 to detachably couple the lower annular frame member 221 with the lampshade body 10.

The frame body 20 further comprises a lamp supporting frame 23 which is made of rigid material, wherein the lamp supporting frame 23 comprises an outer circular frame member 231, an inner circular frame member 232 located inside the outer circular frame member 231 to allow an illuminator suspended thereon, and a plurality of radically supporting ribs 233 having one end attached on the inner circular frame member 232 and the other end attached on the outer circular frame member 231. In other words, the outer circular frame member 231 is associated with the inner circular frame member 232 through the radically supporting ribs 233. The outer circular frame member 231 is inserted into the upper hook recesses 123 of the upper hooks 12 as well as that the lower annular frame member 221 of the lower frame 22 is coupled with the lower hooks 131, and then the upper frame 21 is covered on the lamp supporting frame 23.

It is worth mentioning that the lampshade covering 11 is made of resilient materials, such as paperboards, fabrics, aluminum sheets, or plastic. In other words, the lampshade covering 11 is embodied as a continuous removable band between the lamp supporting frame 23 and the lower fame 22. In addition, the lampshade covering 11 is formed in different shapes to satisfy customers' needs. Preferably, the lampshade covering 11 is formed as rectangular shapes and rolled onto cylindrical shapes or fan-shapes and rolled into conic shapes to concentrate the light beams to achieve a better lighting effect. In addition, the lampshade covering 11 comprises an smooth internal surface 113 and an a rough outer surface 114 to form a transparent covering to allow light beams scattering through the lampshade covering 11, wherein decorative designs created from pens, pencils, markers, or paints can be accepted on the rough outer surface 114 of the lampshade covering 11 to improve the versatile of the decoration for the lampshade covering 11. Therefore, the upper hooks 12 and the lower hooks 13 are coupled on the smooth internal surface 113 of the lampshade covering 11.

As shown in FIG. 4, the lampshade body 10 further comprises an outer surface covering 115 adapted to attach on the rough outer surface 114, wherein the outer surface covering 115 has two edges 1151, 1152 extended to the smooth internal surface 113 to embed the upper hooks 12 and the lower hooks 13. In other words, the upper hooks 12 and the lower hooks 13 are embedded between the smooth internal surface 113 and the outer surface covering 115 to affix the upper and lower hooks 12, 13 on the lampshade covering 11. It is worth mentioning that the outer surface covering 115 is made of non-woven fabric which is not only to enhance the strength of the lampshade covering 11, but also to prevent the high intense light beams entering human's eyes directly.

Accordingly, the lampshade body 10 further comprises a receiving cavity 116 formed inside the lampshade body 10. Since the lampshade covering 11 is made of resilient material, the upper frame 21 and the lamp supporting frame 23 are used to support the lampshade covering 11 to form the receiving cavity 116, so the illuminator in the current market can be deposed inside the receiving cavity to provide illuminating effects.

The upper supporting sheet 212 is attached and extended from a bottom edge 2111 of the upper annular frame member 211, wherein the upper supporting sheet 212 is located below the upper annular frame member 221 and the lower supporting sheet 222 is located above the lower annular frame member 221 while the upper annular frame member 211 is inserted into the upper hook recesses 123 and the lower annular frame member 221 is inserted into the lower hook recesses 133, Therefore, the lower frame 22 and the upper frame 21 are configured towards a same direction. In other words, the lower frame 22 and the upper frame 21 can be exchanged to couple with the lampshade covering 11. That is to say, the lower frame 22 can be coupled with the upper hooks 13 of the lampshade covering 11 while the upper frame 21 is coupled with the lower hooks 12 of the lampshade covering 11.

It is worth mentioning that the lower position slots 224 are adapted to locate the lower hooks 13. The lower hooks 13 are detachably coupled on the lower frame 22, wherein the lower hooks 13 are aligned with the lower position slots 224. In other words, free ends of the lower hooks 13 are slightly passed through the lower position slots 224 formed on the lower supporting sheet 221. Therefore, the lower supporting sheet 221 is not punctured by the free ends of the upper hooks 13.

Accordingly, the upper central hole 214 is aligned with the lower central hole 224 while the lower frame 22 is coupled on the lampshade covering 11 and the upper frame 21 is covered on the lamp supporting frame 23, and the inner circular frame member 232 of the lamp supporting frame 23 is aligned with the upper and lower central hole 211, 221. In addition, a diameter of the inner circular frame member 232 is smaller than that of the upper and lower central hole 211, 221, so the user can change the illuminator supported on the inner circular frame member 232 through the upper central hole 211 or the lower central hole 221. In other words, the user doesn't need to disassemble the lampshade body 10 and the frame body 20 in order to change the illuminator.

Alternatively, a diameter of the upper annular frame member 211, the lower annular frame member 221, and the outer circular frame member 231 are versatile. Sizes of the lower annular frame member 221 and the outer circular frame member 231 can be different, wherein the size of the outer circular frame member 231 can be smaller than the lower annular frame member 221, and the lampshade covering 11 is also supported by the lower frame 22 and the lamp supporting frame 23, so the lampshade covering 11 is formed in a fan-shape and rolled into a conical shape. Otherwise, the size of the outer circular frame member 231 can be larger than the lower annular frame member 221, so the lampshade covering 11 embraces with the lower frame 22 and the outer circular frame member 231 is rolled into an inverted cone. In other words, the size and shape of the upper annular frame member 211 is smaller than that of an opening of the receiving cavity 116, so the upper annular frame member 211 of the upper frame 21 is able to depose inside the receiving cavity 116 through the top opening. In other words, the upper frame 21 is supported on the lamp supporting frame 23.

Alternatively, the upper frame 21, the lower frame 22, and the lamp supporting frame 23 can be rectangular shapes, oval shapes, or heat shapes depending on the customer's needs, wherein the lampshade covering 11 is manufactured to versatile shapes for embracing the lamp supporting frame 23 and the lower frame 22. It is worth mentioning that the upper frame 21 is manufactured to match with the shape of the lamp supporting member 23 and the lower frame 22.

The present invention further provides a method of assembling a lampshade body 10 with a frame body 20, wherein the method comprises the following steps:

(a) Depose a lower frame 22 into the lampshade body 10 for detachably coupling the lower annular frame 221 with a plurality of lower hooks 13. It is worth mentioning that the lower annular frame member 221 of the lower frame 22 is inserted into the lower hook recesses 133 of the lower hooks 13.

(b) Depose a lamp supporting frame 23 inside the lampshade covering 11, and pull up the lamp supporting frame 23 until the upper hook recesses 123 are detachably coupled with the outer circular frame member 231 of the lamp supporting frame 23. It is worth mentioning that the upper annular frame member 211 of the lower frame 21 is inserted into the upper hook recesses 123 of the upper hooks 12.

(c) Depose an upper frame 21 on the lamp supporting frame 23. It is worth mentioning that the upper annular frame member 211 is deposed inside the receiving cavity 116 through the opening.

For assembling the frame body 20 with the lampshade body 10, both of diameters of the upper and lower annular frame members 211, 221 and the outer circular frame member 231 of the lamp supporting frame 23 are smaller than a diameter of the opening of the lampshade covering 11, so the upper frame 21, the lower frame 22, and the lamp supporting frame 23 can be slidably deposed inside the receiving cavity 116 of the lampshade covering 11 in order to form a cylindrical shape covering.

One skilled in the art will understand that the embodiment of the present invention as shown in the drawings and described above is exemplary only and not intended to be limiting.

It will thus be seen that the objects of the present invention have been fully and effectively accomplished. The embodiments have been shown and described for the purposes of illustrating the functional and structural principles of the present invention and is subject to change without departure from such principles. Therefore, this invention includes all modifications encompassed within the spirit and scope of the following claims.

What is claimed is:

1. A lampshade and frame assembly, comprising:

a lampshade body comprising a lampshade covering, which has an upper periphery and a lower periphery, and comprises a plurality of upper hooks spacedly attached on said upper periphery and a plurality of lower hooks spacedly attached on said lower periphery;

a frame body comprising a lamp supporting frame comprising an outer circular frame member detachably coupled with said upper hooks, and a lower frame comprising an lower annular frame member detachably coupled with said lower hooks to associate said lampshade body with said frame body;

an upper frame comprising an upper annular frame member covered on said lamp supporting frame;

wherein each of said upper hook has a downwardly and inwardly extending recess for allowing said outer circular frame member being inserted therein, and each of said lower hooks has a upwardly and inwardly extending recess for allowing said lower annular frame being inserted therein, wherein said lampshade covering further has a smooth internal surface for allowing said upper hooks and said lower hooker attached thereon and a rough outer surface to allow decorative designs to be accepted thereon, wherein said lampshade covering is a rectangular shape and rolled into a cylindrical shape, wherein said lampshade body further has a receiving cavity to allow said upper frame, said lower frame, and said lamp supporting frame deposed therein.

2. The lampshade and frame assembly, as recited in claim 1, wherein said lampshade covering is made of resilient material which is supported by said frame body to form said receiving cavity.

3. The lampshade and frame assembly, as recited in claim 2, wherein sizes of said upper annular frame member, said lower annular frame member, and said outer supporting frame member are smaller than that of said receiving cavity.

4. The lampshade and frame assembly, as recited in claim 3, wherein said lamp supporting frame further comprises an inner circular frame member associated with said upper annular frame member, and a plurality of radically supporting ribs having one end attached on said inner circular frame member and the other end attached on said outer circular frame.

5. The lampshade and frame assembly, as recited in claim 4, wherein said lower frame further comprises a lower supporting sheet connected with an inner periphery of said lower annular frame member, and a lower central hole formed in a center of said lower supporting sheet.

6. The lampshade and frame assembly, as recited in claim 5, wherein said upper frame comprises an upper supporting sheet connected with an inner periphery of said upper annular frame member, and an upper central hole formed in a center of said upper supporting sheet.

7. The lampshade and frame assembly, as recited in claim 6, wherein said upper central hole, said lower central hole, and said inner circular frame member are aligned with each other.

8. The lampshade and frame assembly, as recited in claim 7, wherein said lower supporting sheet comprises a plurality of lower positioning slots spacedly formed adjacent to an outer periphery of said lower supporting sheet to locate said lower hooks.

9. The lampshade and frame assembly, as recited in claim 8, wherein said lower supporting sheet and upper supporting sheet are affixed on said lower annular frame member and said upper annular frame member through non-woven fabrics to secure connections therebetween.

* * * * *